US009185497B2

(12) United States Patent
Liaw et al.

(10) Patent No.: US 9,185,497 B2
(45) Date of Patent: Nov. 10, 2015

(54) METHOD AND COMPUTER PROGRAM PRODUCT OF PROCESSING SOUND SEGMENT AND HEARING AID

(71) Applicants: Vincent Shuang-Pung Liaw, Taipei (TW); Kuan-Li Chao, Taipei (TW); Neo Bob Chih-Yung Young, Taipei (TW); Kuo-Ping Yang, Taipei (TW)

(72) Inventors: Vincent Shuang-Pung Liaw, Taipei (TW); Kuan-Li Chao, Taipei (TW); Neo Bob Chih-Yung Young, Taipei (TW); Kuo-Ping Yang, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 0 days.

(21) Appl. No.: 14/446,942

(22) Filed: Jul. 30, 2014

(65) Prior Publication Data

US 2015/0163600 A1 Jun. 11, 2015

(30) Foreign Application Priority Data

Dec. 10, 2013 (TW) ..... 102145298 A

(51) Int. Cl.
*H04R 25/00* (2006.01)

(52) U.S. Cl.
CPC ..... *H04R 25/35* (2013.01); *H04R 25/353* (2013.01); *H04R 25/356* (2013.01); *H04R 25/505* (2013.01); *H04R 2225/43* (2013.01); *H04R 2430/01* (2013.01); *H04R 2430/03* (2013.01)

(58) Field of Classification Search
CPC .... H04R 25/35; H04R 25/353; H04R 25/356; H04R 25/505; H04R 25/70; H04R 25/75; H04R 2225/39; H04R 2225/41; H04R 2225/43; H04R 2430/01; H04R 2430/03; G10L 21/02; G10L 21/0316; G10L 21/0364
See application file for complete search history.

(56) References Cited

U.S. PATENT DOCUMENTS

| | | | | |
|---|---|---|---|---|
| 6,577,739 | B1 * | 6/2003 | Hurtig | H04R 25/353 381/106 |
| 9,084,050 | B2 * | 7/2015 | Hillis | H04R 3/04 |
| 2002/0118851 | A1 * | 8/2002 | Paludan-Mueller | H04R 25/356 381/317 |
| 2007/0127748 | A1 * | 6/2007 | Carlile | G10L 21/00 381/312 |
| 2011/0040565 | A1 * | 2/2011 | Yang | G09B 21/04 704/271 |
| 2011/0150256 | A1 * | 6/2011 | Baechler | H04R 25/353 381/316 |
| 2011/0249843 | A1 * | 10/2011 | Holmberg | H04R 25/353 381/316 |
| 2012/0076333 | A1 * | 3/2012 | Bauml | H04R 25/353 381/316 |
| 2012/0140964 | A1 * | 6/2012 | Chao | H04R 25/353 381/316 |
| 2014/0023219 | A1 * | 1/2014 | Chao | H04R 25/353 381/320 |
| 2014/0064496 | A1 * | 3/2014 | Li | G10L 21/0364 381/23.1 |
| 2014/0358530 | A1 * | 12/2014 | Young | G10L 21/0364 704/207 |
| 2015/0011192 | A1 * | 1/2015 | Young | H04M 1/72591 455/414.1 |
| 2015/0049879 | A1 * | 2/2015 | Young | H04R 3/04 381/98 |

* cited by examiner

*Primary Examiner* — Curtis Kuntz
*Assistant Examiner* — Joshua Kaufman
(74) *Attorney, Agent, or Firm* — Bacon & Thomas, PLLC

(57) ABSTRACT

A method of processing a sound segment is used in a hearing aid. If the sound segment is a high-frequency type, the high-frequency portion of the sound segment will be processed with a frequency lowering process. If the sound segment is a mixed-frequency type (between high-frequency and low-frequency), the energy of at least some portion of the highfrequency portion of the sound segment will be decreased and then processed with a frequency lowering process.

9 Claims, 5 Drawing Sheets -

METHOD AND COMPUTER PROGRAM PRODUCT OF PROCESSING SOUND SEGMENT AND HEARING AID

BACKGROUND OF THE INVENTION

1. Field of the Invention

The present invention relates to a method of and a computer product for processing sound segments, and a hearing aid, for improving the sound accuracy heard by a hearing-impaired listener.

2. Description of the Related Art

Because most hearing-impaired listeners (including older adults) have more problems hearing high-frequency sounds, a hearing aid is often used for applying a frequency-lowering process on high-frequency sounds.

U.S. Pat. No. 6,577,739 discloses an "apparatus and methods for proportional audio compression and frequency shifting", which provides an understandable audio signal to listeners who have hearing loss in particular frequency ranges by proportionally compressing the audio signal. However, this known prior art compresses all audio signals, which may result in serious sound distortion.

U.S. Pat. No. 7,609,841 discloses a "frequency shifter for use in adaptive feedback cancellers for hearing aids", which improves a conventional frequency shifting method by means of applying frequency shifting only to the high-frequency portion of the signal (which is shifted alternately upward and/or downward), wherein the frequency shifting ratio is less than 6%.

U.S. Pat. No. 7,580,536 discloses a "sound enhancement for hearing-impaired listeners", which applies frequency shifting to the high-frequency portion of the signal.

U.S. Pat. No. 8,582,792 discloses a "method and hearing aid for enhancing the accuracy of sounds heard by a hearing-impaired listener", which determines which portion of the high-frequency audio requires a frequency lowering process.

While processing an input sound in real time, a known technique will first divide the input sound into sound segments, and then determine whether to apply a frequency lowering process on each sound segment. In a common case, such as a vowel followed by a high-frequency consonant (e.g., "at"), a conventional technique applies nothing to all sound segments belonging to "a", and applies the frequency lowering process on all sound segments belonging to "t"; however, the sound between "a" and "t" is usually neither a high-frequency sound nor a low-frequency sound. In this case, if the hearing aid determines that the sound is a high-frequency sound, it will apply the frequency lowering process; otherwise, if the hearing aid determines that the sound is a low-frequency sound, it will not apply the frequency lowering process. However, sometimes it is difficult to classify this kind of intermediate mixed sound, resulting in a rough sound between "a" and "t" while processing "at". None of the abovementioned known prior art references disclose a solution to this problem.

Therefore, there is a need to provide a method and a computer program product of processing sound segments, and a hearing aid, to mitigate and/or obviate the aforementioned problems.

SUMMARY OF THE INVENTION

It is an object of the present invention to provide a method of processing mixed sound segments, wherein the mixed sound segment is a sound segment between high-frequency sounds and low-frequency sounds.

To achieve the abovementioned object, the present invention is used in a hearing aid, and the method includes:

checking a type of a sound segment, wherein the type of the sound segment is selected from at least the following three types: a low-frequency type, a mixed-frequency type and a high-frequency type, wherein the high-frequency type is characterized as having energy over A Hz greater than X % and less than 100%, wherein $1200 \le A \le 3000$, and $50 \le X \le 60$; the mixed-frequency type is characterized as having energy over A Hz less than X % and greater than Y %, wherein $(X-30) \le Y \le (X-5)$; and the low-frequency type is characterized as having energy over A Hz greater than or equal to 0% and less than Y %;

if the sound segment is determined to be the high-frequency type, performing a first frequency lowering process on the sound segment, wherein the first frequency lowering process at least processes a portion of the sound segment with its frequency over B Hz, and the energy of the portion of the sound segment with its frequency over B Hz is not decreased before the first frequency lowering process is performed, where $2000 \le B \le 5000$; and if the sound segment is determined to be the mixed-frequency type, performing a second frequency lowering process, wherein the second frequency lowering process at least processes a portion of the sound segment with its frequency over B Hz, and the energy of the portion of the sound segment with its frequency over B Hz is decreased before the second frequency lowering process is performed. According to one embodiment of the present invention, if the sound segment is determined to be the mixed-frequency type, the lower the proportion of the energy over A Hz is, the greater the proportion of the energy of the portion of the sound segment with its frequency over B Hz that is decreased when the second frequency lowering process is performed.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

To clarify the above and other purposes, features, and advantages of this invention, a specific embodiment of this invention is especially listed and described in detail with the attached figures as follows.

Figure 1:
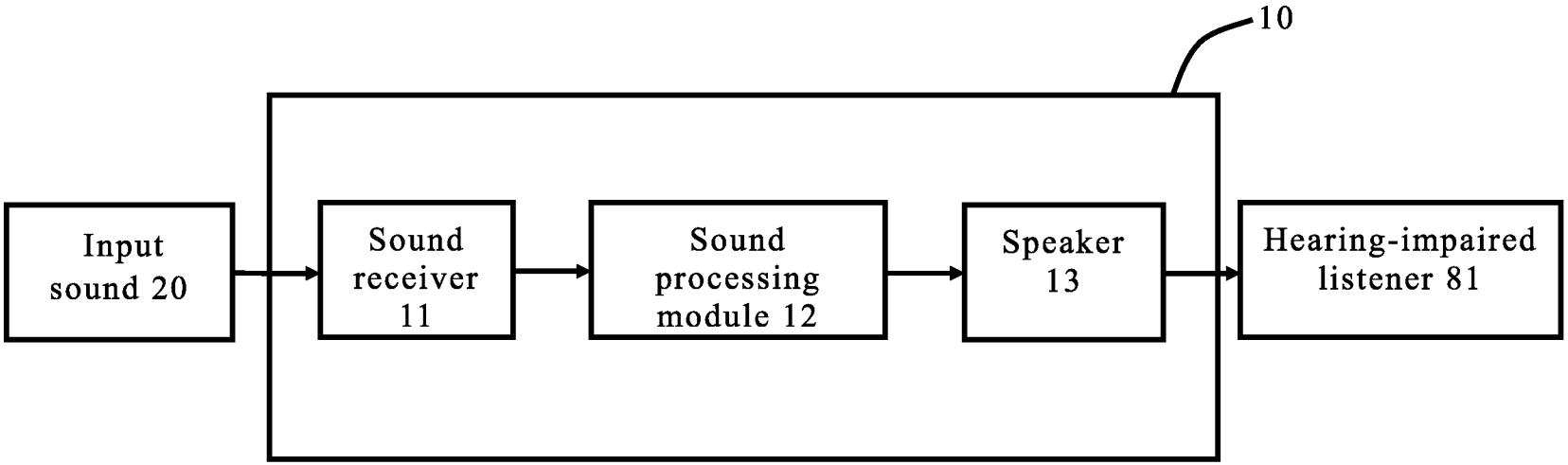
FIG. 1 illustrates a structural drawing of a hearing aid according to the present invention.

Please refer to FIG. 1, which illustrates a structural drawing of a hearing aid according to the present invention.

The hearing aid 10 of the present invention comprises a sound receiver 11, a sound processing module 12 and a speaker 13. The sound receiver 11 is used for receiving an input sound 20. The input sound 20 is processed by the sound processing module 12 for being outputted through the speaker 13 to a hearing-impaired listener 81. The sound receiver 11 can be a microphone or any other equivalent sound receiving equipment, and the speaker 13 (which can also include an amplifier) can be a headphone or any other equivalent sound outputting equipment without being limited to the above scope. The sound processing module 12 is generally composed of a sound effect processing chip associated with a control circuit and an amplification circuit or composed of a solution including a processor and a memory associated with a control circuit and an amplification circuit. The purpose of the sound processing module 12 is to amplify sound signals, to filter out noises, to change the frequency composition of a sound, and to carry out necessary processes according to the object of the present invention. Because the sound processing module 12 can be implemented by utilizing conventional hardware associated with new firmware or software, there is no need for further description of the hardware structure of the sound processing module 12. The hearing aid 10 of the present invention can be a hardware specialized dedicated device, or can be, but is not limited to, a small computer such as a personal digital assistant (PDA), a mobile phone, a hearing-aid headphone (such as a Bluetooth headphone having a chip or a processor for processing audio signals), a smart phone and/or a personal computer with a software program installed.

Figure 2:
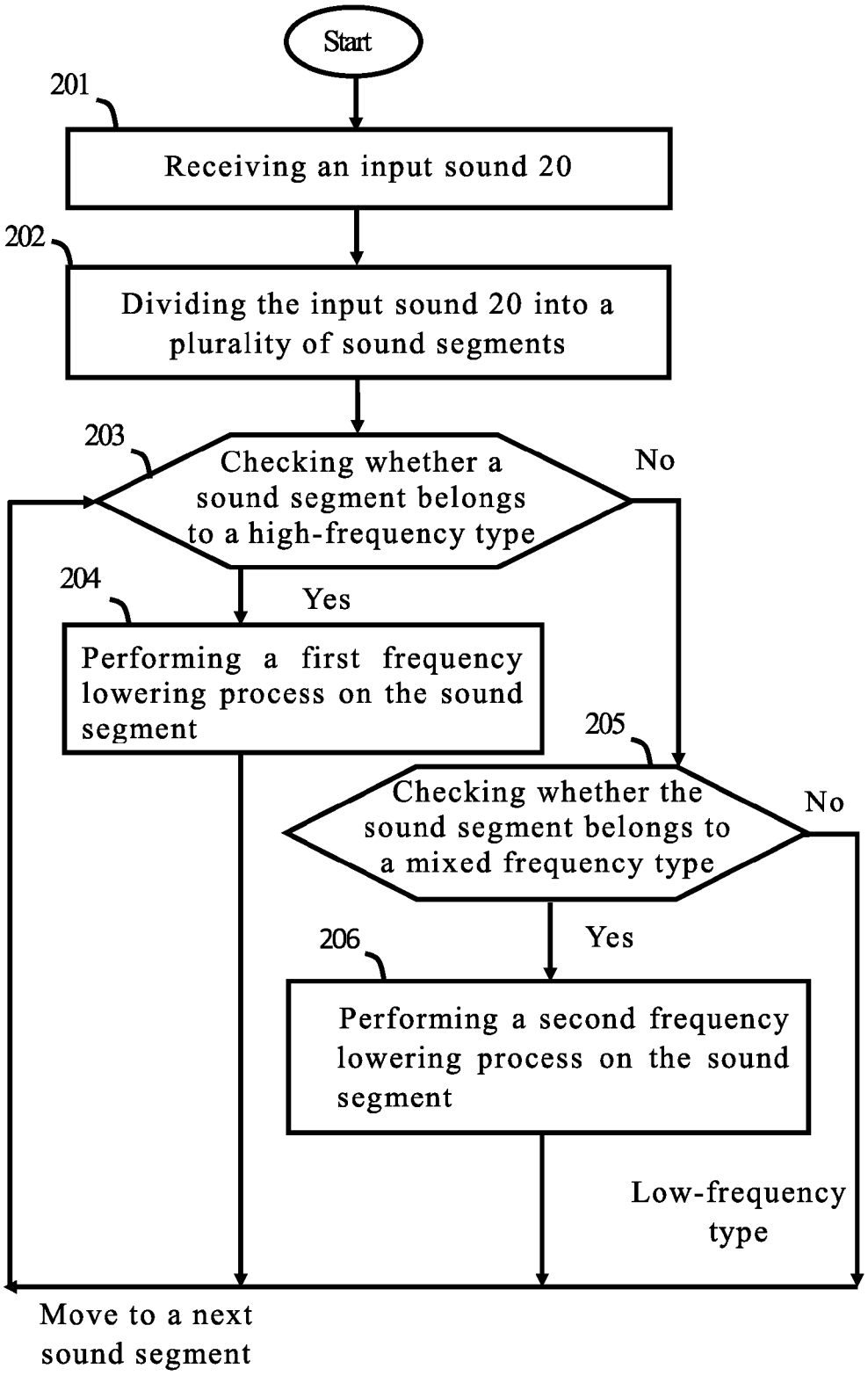
FIG. 2 illustrates a flowchart of a sound processing module according to the present invention.
Figure 3:
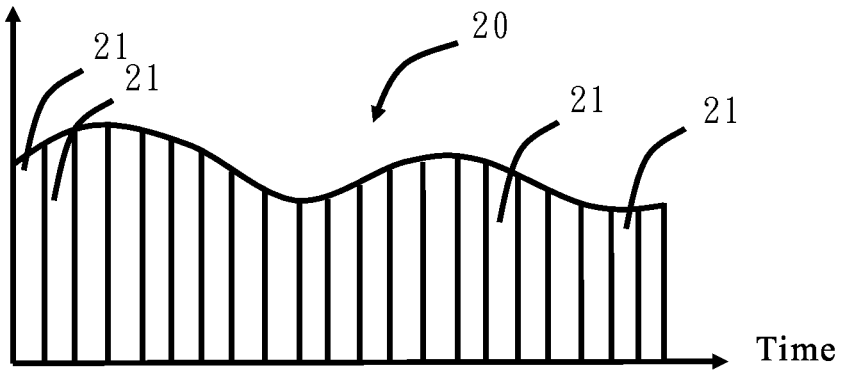
FIG. 3 illustrates a schematic drawing of dividing an input sound into a plurality of sound segments.

Please refer to FIG. 2, which illustrates a flowchart of a sound processing module according to the present invention. Please also refer to FIG. 3 to FIG. 7 for more details of the present invention.

Step 201: Receiving an input sound 20, wherein this step is accomplished by the sound receiver 11.

Step 202: Dividing the input sound 20 into a plurality of sound segments 21. The time length of each sound segment is preferably between 0.0001 and 0.1 second. According to an experiment utilizing an Apple iPhone 4 as the hearing aid device (by means of executing, in the Apple iPhone 4, a software program made according to the present invention), a positive outcome is obtained when the time length of each sound segment is between about 0.0001 and 0.1 second.

Step 203: Checking whether a sound segment belongs to a high-frequency type.

Figure 4:
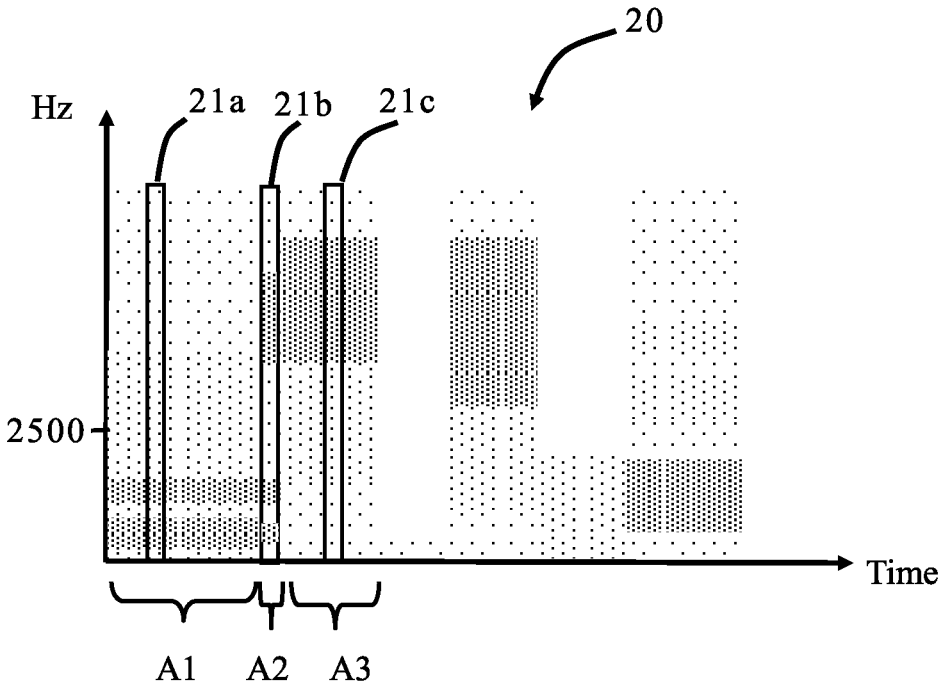
FIG. 4 illustrates a schematic drawing showing sound segments of different types.
Figure 5:
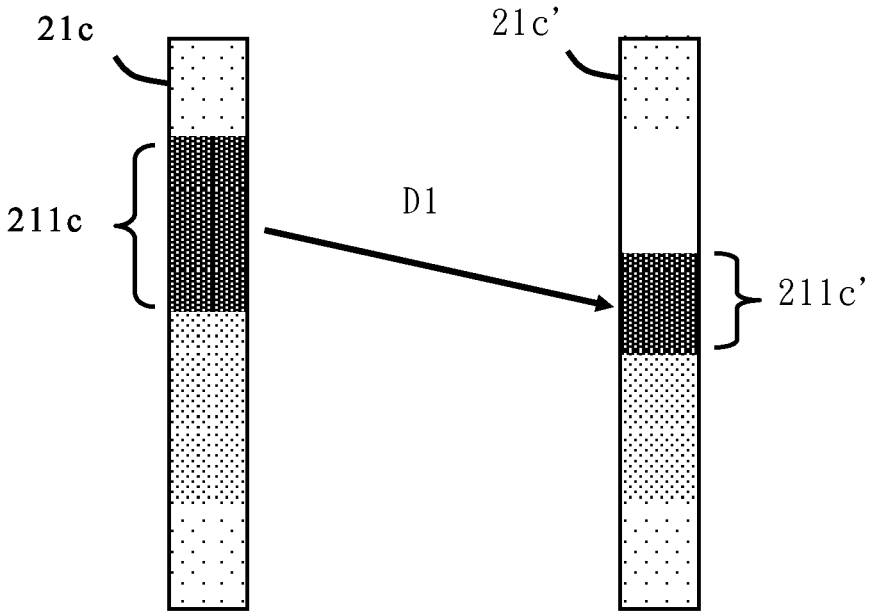
FIG. 5 illustrates a schematic drawing of processing a high-frequency type sound segment.
Figure 6:
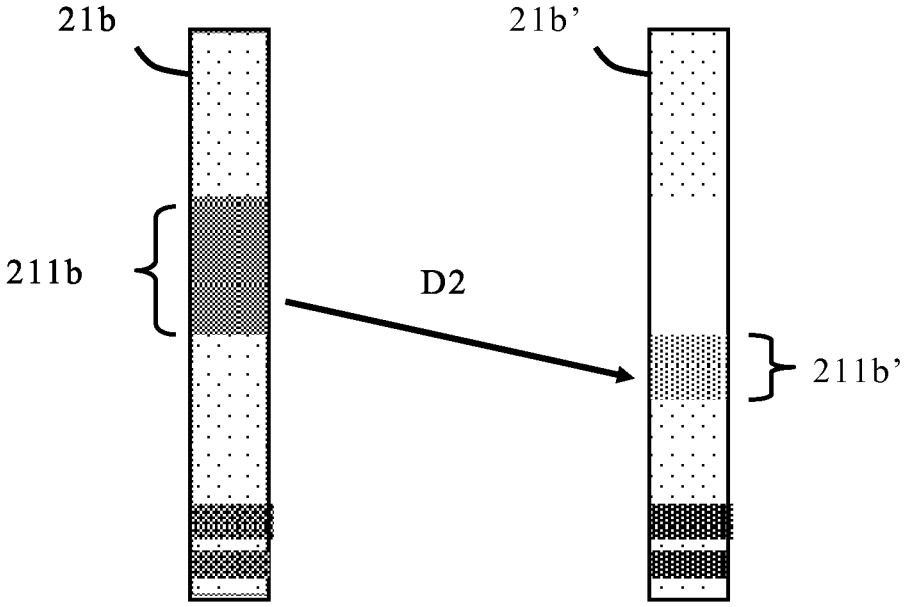
FIG. 6 illustrates a schematic drawing of processing a mixed-frequency type sound segment.

Please refer to FIG. 4. The input sound 20 has sound segments of different types. In FIG. 4, the darker area refers to higher energy. For example, a high-frequency region A3 has more energy over 2500 Hz (this may differ according to different languages). Linguistically, the high-frequency region A3 is usually characterized by a high-frequency consonant (e.g., the pronunciation of T or S in English), such as a high-frequency type sound segment 21*c*. A low-frequency region A1 has more energy under 2500 Hz. Linguistically, the low-frequency region A1 usually refers to a vowel (e.g., the pronunciation of O or A in English) or a low-frequency consonant (e.g., the pronunciation of Z or M in English), such as a low-frequency type sound segment 21*a* as shown. An intermediate region A2 (either from a low-frequency sound to a high-frequency sound, or from a high-frequency sound to a low-frequency sound) in this embodiment refers to an intermediate region A2 between the vowel and the high-frequency consonant. It is common that a high-frequency consonant and a vowel are mixed in this region, such as a mixed-frequency type sound segment 21*b*.

The high-frequency type sound segment 21*c* is characterized by having energy over A Hz greater than X % and less than 100%, wherein $1200 \leq A \leq 3000$, and $50 \leq X \leq 60$. The value would be different due to the type of language, or man or woman's voice. Usually when A is set to a smaller value, X will be set to a larger value. In an experiment in Mandarin, the software program developed by the inventor provides one example of A=1500 and X=55.

If step 203 determines that the sound segment belongs to the high-frequency type, the method performs step 204; otherwise, the method performs step 205.

Step 204: Performing a first frequency lowering process D1 on the sound segment. The first frequency lowering process D1 at least processes a portion of the sound segment with its frequency over B Hz, wherein the energy of the portion of the sound segment with its frequency over B Hz is not decreased before the first frequency lowering process D1 is performed, wherein $2000 \leq B \leq 5000$.

Performing a frequency lowering process on a high-frequency type sound segment is a known technique. The frequency lowering process basically includes a frequency compression process and/or a frequency shifting process. For example, the major energy portion of the sound segment with a higher frequency is shifted to a lower frequency by means of the frequency shifting process; the major energy portion of the sound segment with a higher frequency is compressed to a lower frequency by means of the frequency compression process; or the frequency shifting process and the frequency compression process can both be carried out to achieve the frequency lowering purpose. For example, the energy of the high-frequency type sound segment 21*c* in the high-frequency portion is in a high-frequency centralized portion 211*c* having a frequency between 4000 Hz and 6000 Hz; therefore, the invention performs the frequency compression process on the high-frequency centralized portion 211*c* to compress its frequency to 4000~5000 Hz, and then performs the frequency shifting process on the high-frequency centralized portion 211*c* to shift its frequency to 3500~4500 Hz (by down-shifting 500 Hz). Therefore, the sound segment 21*c* having the high-frequency centralized portion 211*c* (with its frequency between 4000 Hz and 6000 Hz) now becomes a sound segment 21*c*' having a frequency-lowered centralized portion 211*c*' (with a frequency between 3500 Hz and 4500 Hz). Please note that the frequency compression process and the frequency shifting process are both known techniques and that the abovementioned description is provided only as an example. For example, please refer to U.S. Pat. No. 8,582,792 filed by the applicant for more details. Because the purpose of the present invention is not to improve the frequency compression process and the frequency shifting process, such as a frequency compression ratio or a selected range of frequency compression, there is no need for further description in this disclosure. Furthermore, the value of B is determined according to the condition of the hearing-impaired listener. A more seriously hearing-impaired listener needs to apply a smaller B value, while a mildly hearing-impaired listener can hear sounds of slightly higher frequency and therefore can apply a larger B value.

In step 204, please note that energy of the portion of the sound segment with its frequency over B Hz is not decreased before the first frequency lowering process D1 is performed. That is, the energy of the high-frequency centralized portion 211*c* is not decreased before the first frequency lowering process D1 is performed.

Step 205: Checking whether the sound segment belongs to a mixed-frequency type. The mixed-frequency type is characterized by having energy over A Hz less than X % and greater than Y %, wherein $(X-30)\leq Y\leq(X-5)$. If step 205 determines that the sound segment belongs to the mixed-frequency type, the method performs step 206; otherwise, the sound segment is determined to be a low-frequency type (such as a vowel or a low-frequency consonant), and the method then moves to a next sound segment. If the sound segment belongs to the low-frequency type, it is characterized by having energy over A Hz greater than or equal to (≥) 0% and less than Y %.

Step 206: Performing a second frequency lowering process D2 on the sound segment. If the sound segment belongs to the mixed-frequency type 21*b*, the method performs a second frequency lowering process D2 on the sound segment. The second frequency lowering process D2 at least processes a portion of the sound segment with its frequency over B Hz, wherein the energy of the portion of the sound segment with its frequency over B Hz is decreased before the second frequency lowering process D2 is performed. The second frequency lowering process D2 also performs a frequency compression process and/or a frequency shifting process on a high-frequency centralized portion 211*b*. Moreover, the purpose of this step is to decrease the energy of the high-frequency centralized portion 211*b*, and finally to form a frequency-lowered centralized portion 211*b*'. For example, the invention first decreases the energy of the high-frequency centralized portion 211*b*, then performs the frequency shifting process or the frequency compression process, and finally forms the frequency-lowered centralized portion 211*b*'; alternatively, the invention first performs the frequency compression process on the high-frequency centralized portion 211*b*, decreases the energy before frequency shifting, and finally performs the frequency shifting process to form the frequency-lowered centralized portion 211*b*'. The abovementioned steps 202-206 are executed by the sound processing module 12.

Figure 7:
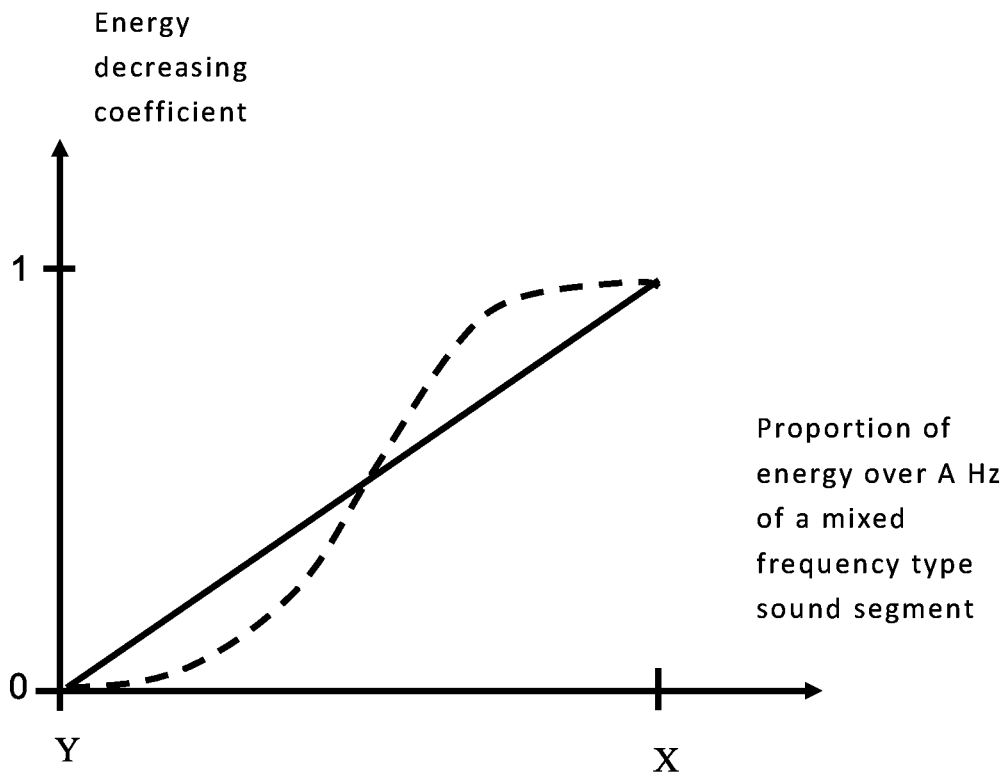
FIG. 7 illustrates a schematic drawing of energy decreasing coefficients.

The process of decreasing energy can be multiplied by an energy decreasing coefficient, wherein the energy decreasing coefficient is less than 1 and greater than 0, as shown in FIG. 7. Basically, the lower the proportion of the energy over A Hz is, the greater the proportion of the energy of the portion of the sound segment with its frequency over B Hz that is decreased when the second frequency lowering process is performed. For example, in the case that the energy of the mixed-frequency type sound segment over 1500 Hz is greater than 40% (i.e. Y %) and less than 50% (i.e. X %), then if the energy of one sound segment over 1500 Hz is 49%, then the energy decreasing coefficient is 0.9, which means that the high-frequency centralized portion 211*b* will keep 90% of its energy to perform the frequency compression/shifting process; however, if the energy of one sound segment over 1500 Hz is 47%, then the energy decreasing coefficient is 0.7, which means that the high-frequency centralized portion 211*b* will keep 70% of its energy to carry out the frequency compression/shifting process; or, if the energy of one sound segment over 1500 Hz is 41%, then the energy decreasing coefficient is 0.1, which means that the high-frequency centralized portion 211*b* will keep 10% of energy to carry out the frequency compression/shifting process. The energy decreasing coefficient in the above example is linear (such as the solid line shown in FIG. 7); alternatively, the energy decreasing coefficient may be nonlinear (such as the dotted line shown in FIG. 7).

The meaning of the second frequency lowering process is that if the mixed-frequency type sound segment is closer to the high-frequency type sound segment, the mixed-frequency type sound segment is processed in a way closer to how the high-frequency sound segment is processed; that is, more high-frequency energy is kept and shifted to the low-frequency portion; and if the mixed-frequency type sound segment is closer to the low-frequency type sound segment, the mixed-frequency type sound segment is processed in a way closer to how the low-frequency type sound segment is processed; that is, less high-frequency energy will be shifted to the low-frequency portion, and thus the low-frequency portion is less changed.

Please note that the abovementioned processed sound segment will usually go through an energy amplification process performed by the speaker 13 (such as a headphone, a speaker or an amplifier), such that the hearing-impaired listener 81 can hear the sound. The abovementioned steps are intended to describe the processing of the sound segment before the energy amplification process.

Although the present invention has been explained in relation to its preferred embodiments, it is to be understood that many other possible modifications and variations can be made without departing from the spirit and scope of the invention as hereinafter claimed.

What is claimed is:

1. A method of processing a sound segment, used in a hearing aid, the method comprising:

checking a type of the sound segment, wherein the type of the sound segment is selected from at least the following three types: a low-frequency type, a mixed-frequency type and a high-frequency type, wherein:

the high-frequency type is characterized by having energy over A Hz greater than X % and less than 100%, wherein $1200\leq A\leq 3000$, and $50\leq X\leq 60$;

the mixed-frequency type is characterized by having energy over A Hz less than X % and greater than Y %, wherein $(X-30)\leq Y\leq(X-5)$; and the low-frequency type is characterized by having energy over A Hz greater than or equal to 0% and less than Y %;

if the sound segment is determined to be the high-frequency type, performing a first frequency lowering process on the sound segment, wherein the first frequency lowering process at least processes a portion of the sound segment with its frequency over B Hz, and the energy of the portion of the sound segment with its frequency over B Hz is not decreased before the first frequency lowering process is performed, where $2000\leq B\leq 5000$; and if the sound segment is determined to be the mixed-frequency type, performing a second frequency lowering process, wherein the second frequency lowering process at least processes a portion of the sound segment with its frequency over B Hz, and the energy of the portion of the sound segment with its frequency over B Hz is decreased before the second frequency lowering process is performed.

2. The method of processing a sound segment as claimed in claim 1, wherein in the second frequency lowering process, the energy of the portion of the sound segment with its frequency over B Hz is decreased between 100% and 0%.

3. The method of processing a sound segment as claimed in claim 2, wherein if the sound segment is determined to be the mixed-frequency type, the lower the proportion of the energy over A Hz is, the greater the proportion of the energy of the portion of the sound segment with its frequency over B Hz that is decreased when the second frequency lowering process is performed.

4. A computer product, capable of executing the method as claimed in claim 3 afer being loaded onto and executed by a hearing aid.

5. A computer program product, capable of executing the method as claimed in claim 2 after being loaded onto and executed by a hearing aid.

6. A computer program product, capable of executing the method as claimed in claim 1 after being loaded onto and executed by a hearing aid.

7. A hearing aid, used for receiving an input sound, and capable of modifying the input sound for being outputted to a hearing-impaired listener, the hearing aid comprising:

a sound receiver, used for receiving the input sound;

a sound processing module, electrically connected to the sound receiver, used for dividing the input sound into a plurality of sound segments, and checking a type of each of the sound segments, wherein the type of the sound segment is selected from at least the following three types: a low-frequency type, a mixed-frequency type and a high-frequency type, wherein:

the high-frequency type is characterized by having energy over A Hz greater than X % and less than 100%, wherein $1200 \leq A \leq 3000$, and $50 \leq X \leq 60$;

the mixed-frequency type is characterized by having energy over A Hz less than X % and greater than Y %, wherein $(X-30) \leq Y \leq (X-5)$; and the low-frequency type is characterized by having energy over A Hz greater than or equal to 0% and less than Y %;

if the sound segment is determined to be the high-frequency type, the sound processing module performing a first frequency lowering process on the sound segment, wherein the first frequency lowering process at least processes a portion of the sound segment with its frequency over B Hz, and the energy of the portion of the sound segment with its frequency over B Hz is not decreased before the first frequency lowering process is performed, where $2000 \leq B \leq 5000$; and if the sound segment is determined to be the mixed-frequency type, the sound processing module performing a second frequency lowering process on the sound segment, wherein the second frequency lowering process at least processes a portion of the sound segment with its frequency over B Hz, and the energy of the portion of the sound segment with its frequency over B Hz is decreased before the second frequency lowering process is performed.

8. The hearing aid as claimed in claim 7, wherein the energy of the portion of the sound segment with its frequency over B Hz is decreased between 100% and 0%.

9. The hearing aid as claimed in claim 8, wherein if the sound segment is determined to be the mixed-frequency type, the lower the proportion of the energy over A Hz is, the greater the proportion of the energy of the portion of the sound segment with its frequency over B Hz that is decreased when the second frequency lowering process is performed.

* * * * *